United States Patent [19]

Birkle et al.

[11] 4,419,204

[45] Dec. 6, 1983

[54] INSTALLATION FOR THE ELECTRO-DEPOSITION OF METALS, PARTICULARLY ALUMINUM

[75] Inventors: Siegfried Birkle, Hoechstadt; Johann Gehring, Spardorf; Klaus Stoeger, Nuremberg, all of Fed. Rep. of Germany

[73] Assignee: Siemens Aktiengesellschaft, Berlin & Munich, Fed. Rep. of Germany

[21] Appl. No.: 419,546

[22] Filed: Sep. 20, 1982

[30] Foreign Application Priority Data

Sep. 23, 1981 [DE] Fed. Rep. of Germany ..... 3137908

[51] Int. Cl.[3] ..... C25D 17/00

[52] U.S. Cl. ..... 204/206; 204/207

[58] Field of Search ..... 204/206, 207, 208, 209, 204/211, 210

[56] References Cited

U.S. PATENT DOCUMENTS 1,768,358 6/1930 Harrison ..... 204/206 X
2,445,675 7/1948 Lang ..... 204/209
2,974,097 3/1961 Ramirez et al. ..... 204/206
3,551,316 12/1970 Gale ..... 204/206
3,865,701 2/1975 Borgmann ..... 204/28

*Primary Examiner*—T. M. Tufariello
*Assistant Examiner*—T. Williams
*Attorney, Agent, or Firm*—Hill, Van Santen, Steadman & Simpson

[57] ABSTRACT

An installation for electro-depositing metal, such as aluminum, on elongated goods such as tapes or wires characterized by a tubular cell, which is closed to the outside and provided with airlock arrangements at each end so that goods can be conveyed therethrough in contact with an electrolyte for electroplating. The cell is formed of a plurality of interconnected rectangular tubes with each tube having a flange at each end for forming a connection and receiving interchangeable nonconductive insert pieces, which match the interior dimensions of the tube and have at least two longitudinal channels for guiding the goods to be metallized and for positioning anodes to surround the goods to be metallized in the flow of electrolyte.

9 Claims, 7 Drawing Figures

INSTALLATION FOR THE ELECTRO-DEPOSITION OF METALS, PARTICULARLY ALUMINUM

BACKGROUND OF THE INVENTION

The invention relates to an installation for the electro-deposition of metals, particularly of aluminum from aprotic, oxygen-free and water-free, aluminum-organic electrolyte, onto wire-shaped, tubular or tape-shaped goods. The installations or device comprises a tubular cell through which the cathodically contacted goods to be treated can be moved, preferably continuously, in an axial direction along anodes and through which cell the electrolyte can be can be pumped with the assistance of a closed electrolyte circulation system in a direction opposite the direction of the movement of the goods. The device also includes lock arrangement for preventing an outflow of the electrolyte from the tubular cell at each end of said tubular cell, and the lock arrangement consists of a plurality of chamber.

An electro-deposition installation with a tubular cell for precipitating metals, particularly precious metals, has been disclosed by the U.S. Pat. No. 3,865,701. Although the tubular cell at each end has a lock arrangement or means, atmospheric oxygen and humidity cannot be prevented from coming into contact with the electrolyte. Therefore, this type of an installation is not suited for the electro-deposition of aluminum because the electrolyte, which must be employed for aluminization, must be manufactured under oxygen-free and water-free conditions and must be kept under these conditions insofar as practically possible. In order, however, to make such an installation suitable for the electro-deposition of aluminum, it is proposed in a copending U.S. patent application Ser. No. 270,129 filed June 3, 1981 and based on German patent application No. P 30 23 827.8 that the tubular cell is charged with a protective atmosphere of an inert gas with respect to lie outside and that the individual chambers of the lock arrangements or mean are sealed from one another by inert gas and/or inert liquid. In addition, a T-shaped connector is disposed between each end of the tubular cell and its lock arrangement in order to start and stop the flow of the electrolyte as well as to reverse the direction of motion of the flowing electrolyte. Each T-shaped connectors exhibiting a diaphragm with an aperture for deflecting the electrolyte stream vertically and for preventing a longitudinal passage of the electrolyte. The aperture of each diaphragm exhibits a passage tightly matched to the shape of the cross-section of the goods that are being treated. In order to seal the individual chambers in the device of the application, at least one disk-shaped chamber wall of the lock mean has a radial bore leading to an opening in the wall for the passage of the goods to be treated, and the bore is connected to an inert liquid circulation by a pipe union or connection. The opening in the chamber wall can be supplied with inert liquid from this bore in such manner that it practically forms a fluid lock which prevents the entry of atmospheric air and also prevents the electrolyte from emerging. This principle can be and is also employed for rinsing the treated goods, and it is then expedient that the inert liquid required for that purpose is produced by means of distillation of the liquid from the electrolyte and that this inert liquid, which then becomes enriched with the electrolyte, is then reintroduced to the electrolyte supply of the circulation system.

Tubular cells with a round cross-section are employed both in the electro-plating installation which is disclosed in the U.S. Pat. No. 3,865,701 and in the installation disclosed in the above mentioned copending patent application and the lock arrangements or means which are connected to the two ends of the tubular cells, also exhibit a round profile in cross-section. Both the tubular cells as well as the lock arrangements consist of synthetic plastic and require a very high manufacturing outlay or cost. The manufacture of the lock arrangement for the installation disclosed by the U.S. Pat. No. 3,865,701 is particularly very involved because the lock housing practically consists of one piece. Because the individual chambers of the lock arrangements of the installation of the earlier patent application consist of pipe pieces and disk-shaped chamber walls, this lock arrangement somewhat facilitates manufacture and reduces cost.

SUMMARY OF THE INVENTION

The present invention is directed to a device or installation for electro-depositing of metals such as aluminum from an aprotic, oxygen-free and water-free aluminum-organic electrolyte onto elongated goods such as wire-shaped, tubular or tape shaped goods, which installation or device is more simple and economical in construction and which has possibility of enabling depositing materials simultaneously on a plurality of goods to achieve a higher output for the installation without significantly additional cost. In addition, the device of the present invention enables treating goods by only coating partial portions thereof.

To accomplish these objects, the present invention is directed to an improvement in an installation or device for electro-depositing of metal particularly for the depositing of aluminum from an aprotic, oxygen-free and water-free aluminum-organic electolyte onto elongated goods said installation or device comprising a tubular cell, which is closed to the outside, receives the goods to be treated, has anodes extending therealong and has means to cathodically contact the goods to be treated, conveying means for moving the goods continuously in an axial direction in the cell along the anodes, pump means for circulating the electrolyte through the cell in a direction opposite the direction of motion of the goods, said cell having lock means consisting of a plurality chambers for preventing the outflow of electrolyte from the tubular cell disposed at each end of the tubular cell. The improvements include said tubular cell comprising at least two interconnected rectangular metal tubes with each tube having a flange at each end for forming a connection and interchangeable, non-conductive insert pieces being disposed in said tubular cell, said pieces being matched to the interior dimensions of the rectangular tube and being shaped to provide longitudinal channels for guiding the goods to be metallized as they are conveyed there through and channels for positioning the anodes to surround the goods to be metallized in the flow of electrolyte.

By utilizing two or more rectangular shaped tubes which are connected together to form the tubular cell, a tubular cell of different lengths can be manufactured with relatively low cost and the individual components can be dimensioned in such a manner that they can be easily transported. The insert pieces can be relatively easily interchangeable so that the installation is very flexible in design and construction. Preferably, the interchangeable insert pieces are disposed in oppositely positioned pairs with their outer surfaces being matched to the inner dimensions of the rectangular tube and the surfaces facing each other being provided with the longitudinal recesses or grooves which form the channel for guiding the goods which are being treated and for the positioning of the elongated anodes adjacent to sides of the goods. The anodes, which normally lie at the outside of the goods being treated likewise expediently are utilized for shielding the electrolyte from the metal inside wall of the rectangular tube and it is desirable that the recesses for the anodes are designed in such a manner that an additional insert piece can be supported against the anode. In a very simple design, the insert pieces are connected to the anodes in such a manner that the two insert pieces or pair of pieces form a unit which can be inserted into the rectangular tube.

Each of the units practically forms a rectangular tube with planar end faces consisting of the non-conductive material. The outer dimensions of the pieces of the unit are dimensioned in such a manner that they can be expediently introduced into the metallic tubes forming the outer envelope. Each unit exhibits at least the length of the corresponding rectangular tube and it is desirable that when a plurality of rectangular tubes are combined to form the tubular cell, the assembly is undertaken in such a manner that the end faces of each of the coupled pairs of pieces do not fall in the plane of the fastening flange of the rectangular tubes. By such a construction a better seal is formed and in addition a better centering of the individual insert pieces will be achieved.

As a result of utilizing a tubular cell with a rectangular cross-section, the possibility exists that a plurality of wire or tapes, such as bands or straps, can be simultaneously coated without the additional outlay being increased.

In one embodiment, the pairs of insert pieces have a outer dimension which is slightly smaller than the inner dimension of the rectangular outer tube. To insure the desired position, the rectangular tubes and insert pieces have centering springs disposed on two surfaces to bias the pair of insert pieces into one corner of the tube.

The means for cathodically contacting the goods being treated can be designed as contact pins which are inserted through the outside of the rectangular tubes to extend into the longitudinal grooves in which the goods being treated are guided. To insulate the pins from the tubes, they are received in sleeves of insulative material.

DESCRIPTION OF THE PREFERRED EMBODIMENTS

Figure 1:
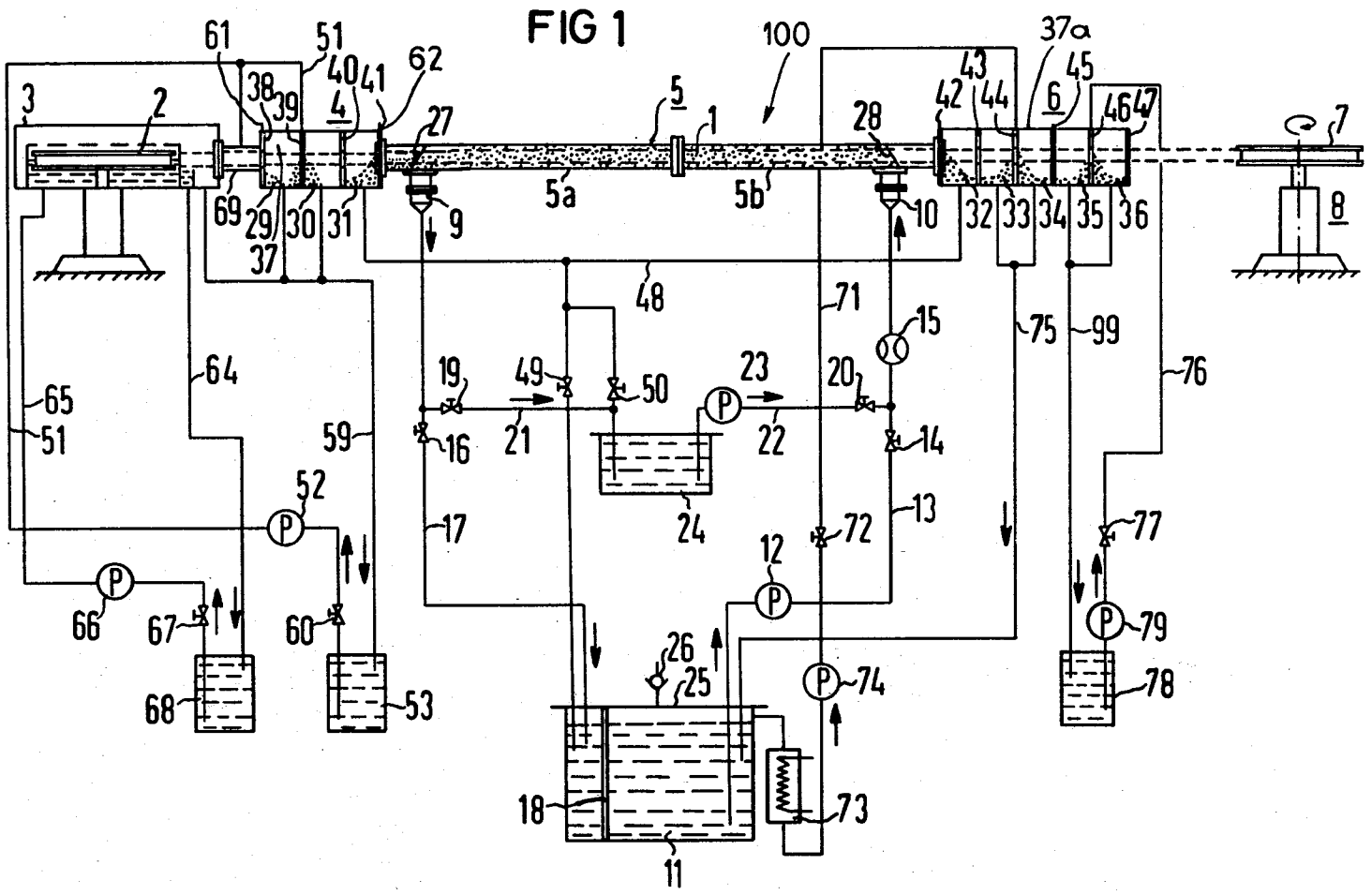
FIG. 1 is a schematic illustration of an installation for electro-deposition in accordance with the invention.

The principals of the present invention are particularly useful when incorporated in a device or installation generally included at 100 in FIG. 1.

Figures 2, 2A, 2B, 2C, 2D, 2E:
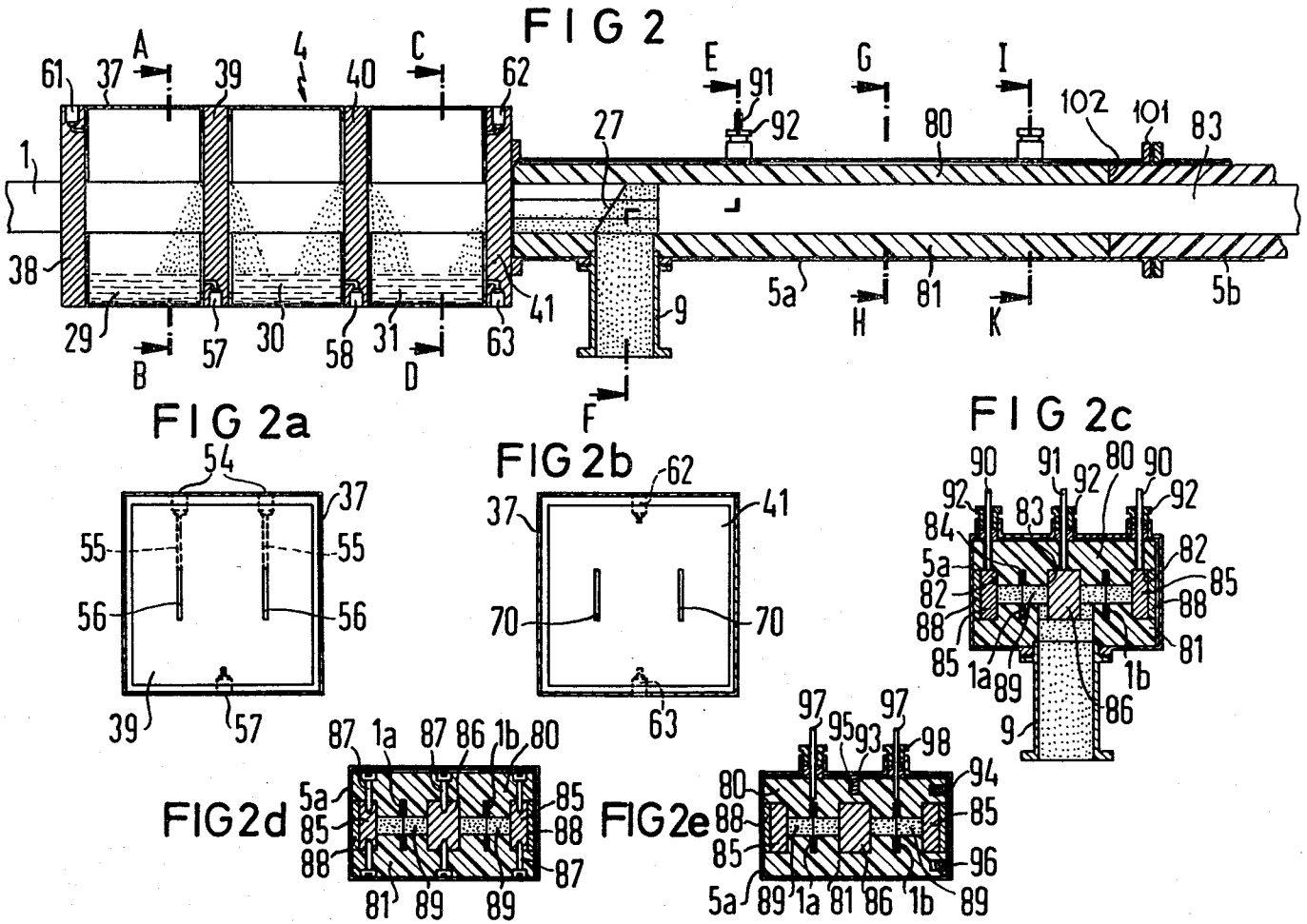
FIG. 2 is a longitudinal cross-sectional view of a part of a tubular cell and a lock arrangement of the installation of FIG. 1.
FIG. 2*a* is a cross-sectional view along the line A-B of FIG. 2.
FIG. 2*b* is a cross-sectional view along the line C-D of FIG. 2.
FIG. 2*c* is a cross-sectional view along the line E-F of FIG. 2.
FIG. 2*d* is a cross-sectional view along the line G-H of FIG. 2.
FIG. 2*e* is a cross-sectional view along the line I-J.

The installation 100 serves for the electro-deposition of aluminum from an aprotic, oxygen-free and water-free, aluminum-organic electrolyte onto a tape-shaped product or goods 1. In the selected sample embodiment, the goods 1 is drawn off of a roll 2 of an uncoiling or unreeling unit 3, and is introduced through a lock arrangement 4, into a tubular cell 5. After being conducted through the tubular cell 5 for the purpose of aluminization, the tape exits the cell 5 through a lock arrangement 6, and is wound up on a roll 7 of a coiling or take-up unit 8. Thus the take-up unit 8 and uncoiling unit 3 form conveying means for moving the goods such as a tape continuously through the tubular cell 5. As shall be explained in greater detail and/or illustrated in FIGS. 2*c*, 2*d* and 2*e*, two tapes 1*a* and 1*b* can be simultaneously aluminized as a result of the rectangular cross-sectional shape of the tubular cell 5. As illustrated in FIG. 2*c*, a partial aluminization is also possible in a simple manner. To provide simultaneous aluminization of two tapes, the conveying means of the installation 100 of FIG. 1 needs only to be augmented by an additional roll in each of the uncoiling unit 3 and the take-up unit 8. The drive of the rolls in each unit can be undertaken by the same drive motor, however with a reversed sense of direction.

Adjacent the lock arrangement 4, the tubular cell 5 has a discharge nozzle 9 and adjacent the lock arrangement 6 the cell has an intake nozzle 10. Both the nozzles 9 and 10 extend perpendicularly relative to the longitudinal axis of the tubular cell 5 in the selected sample embodiment. Expediently, however, they can also be disposed to be inclined to the flow direction, as is the case in the known tubular cell according to the U.S. Pat. No. 3,865,701. The discharge nozzle 9 and the intake nozzle 10 are connected to an electrolyte circulation system which has an electrolyte sump or reservoir 11. With the assistance of a pump 12, the electrolyte is pumped from the reservoir 11 through a line 13, a valve 14, a flow meter 15 and the intake nozzle 10 into the tubular cell 5. The electrolyte flows in the cell 5 in a direction which is opposite that of the direction of motion of the tape-shaped goods 1 and is discharged from the cell 5 through discharge nozzle 9 which is connected by a line 17 with a valve 16 to the electrolyte reservoir 11. The discharge from line 16 is separated by a filter 18 from the intake of pump 12. The electrolyte circulation can be interrupted by closing the valves 14 and 16. For example, when the tubular cell 5 is placed in operation, the valves 14 and 16 are closed and inert liquid, for example toluene, can be pumped by a pump 23 from an inert liquid reservoir 24 through a line 22 with a valve 20 being opened to the nozzle 10 of the tubular cell 5. From cell 5 the inert liquid is discharged from nozzle 9 through opened valve 19 and line 21 back to reservoir 24. The inert liquid on the one hand, is used to remove or purge the atmospheric air from the tubular cell 5 before the electrolyte is pumped through the cell 5 under a protective gas atmosphere of $N_2$ and, on the other hand, after the electrolyte has been withdrawn the inert liquid is used to clean or flush the tubular cell 5.

The electrolyte reservoir 11 is closed air-tight with the assistance of a cover 25 and is equipped with a pressure control valve 26. As illustrated the lines are introduced through the cover air-tight and the electrolyte reservoir 11 is also placed under a protective gas atmosphere of $N_2$. In order to prevent emergence of the electrolyte from the tubular cell 5, a diaphragm 27 is provided at the discharge nozzle 9 and a diaphragm 28 is provided at the intake nozzle 10. Each diaphragm is provided with slots for the passage of the goods 1 to be treated, and the size and shape of the slots match the cross-section of the goods in such manner that as little electrolyte as possible can be transferred or escapes into the lock arrangements 4 and 6.

Since it is impossible to absolutely prevent some electrolyte from passing through each diaphragm and since there is a danger that atmospheric air can penetrate into the cell 5 and, thus, deteriorate the electrolyte, each of the lock arrangements 4 and 6 which, or course, must allow the goods to pass therethrough, are specially designed. The lock arrangement 4 consists of three chambers 29–31, the lock arrangement 6 has five chambers 32–36. The chambers 29–31 are formed by a rectangular tube 37 with chamber walls 38–41 and the chambers 32–36 are formed by a rectangular tube 37*a* and chamber walls 42–47. Inert gas $N_2$ and/or inert liquid for forming liquid locks can be introduced into the individual chambers 29–36 and re-extracted therefrom through bores in the chamber walls, as shall be explained in greater detail on the basis of FIG. 2. By supplying inert liquid to the chamber in this manner, the possibility also exists of washing off any electrolyte which is still adhering to the treated goods after passage through the tubular cell 5. The chambers 31 and 32 particularly serve to collect the electrolyte and are connected to discharge into the electrolyte reservoir 11 by a line 48 with a valve 49. The line 48 is also connected by a valve 50 to the inert liquid reservoir 24 so that the chambers 31 and 32 can also be cleaned with inert liquid. The connection of the line to each chamber 31 and 32 can be by a threaded connecting bore in each of the walls 41 and 42 such as illustrated in FIG. 2 by bore 63 in wall 41.

The chamber wall 39 which is situated between the chambers 29 and 30 exclusively serves to form a liquid lock. Inert liquid from a reservoir 53 is supplied by a pump 52 to a line 51 which has valve 60 to the chamber wall 39. As best illustrated in FIG. 2*a*, the wall 39 has a pair of passages or openings 56, 56 whose shape is matched to the cross section of the goods being treated. Each passage 56 is connected to a bore or passage 55 that ends in a bore 54 which is connected to line 51. Inert liquid is now supplied to each of the passages 56 in such an amount that these passages 56 are always fully filled with inert liquid and are thus, closed air-tight. The chamber wall 39 at a lower end has a connecting bore 57 which is connected to or is in communication with the chamber 29. The bore 57 could also be connected to the chamber 30, however, as illustrated in FIG. 2, the chamber 30 is emptied by a connecting bore 58 in the chamber wall 40. The bores 57 and 58 are connected to a line 59 (FIG. 1) which extends to reservoir 53 so that the inert liquid in the chamber 29 and 30 is re-supplied to the inert liquid reservoir 53.

Since, the inert liquid should not come into contact with atmospheric oxygen insofar as possible, an inert gas atmosphere of $N_2$ is provided in the chambers of each lock arrangement 4 and 6. As illustrated in FIG. 2, the walls 39 and 41 have connecting bores 61 and 62 to enable applying inert gas to the lock means.

In the selected sample embodiment, the roll 2 of the uncoiling unit 3 (FIG. 1) is likewise self-contained and partially filled with inert liquid. This inert liquid can be supplied with the assistance of a pump 66 and valve 67 from a container 68 over line 65. The unit 3 can be emptied by a line 64 when replacing an empty roll 2 with a full roll 2. The uncoiling unit 3 is also under a protective gas atmosphere of $N_2$ and, in the selected sample embodiment, is tightly connected by a rectangular pipe union 69 to the chamber 29 of the lock arrangement 4. The rectangular pipe union 69 also has an insert with passages matched to the cross-section of the goods to be treated. These passages are provided with inert liquid by a connection from line 51.

The chamber wall 41 (FIG. 2*b*), just like the chamber walls 38 through 40, likewise exhibits passages 70 which are matched to the cross-section of the goods to be treated in such manner that as little electrolyte as possible can pass from the tubular cell 5 into the chamber 31.

As can be seen from FIG. 1, the lock arrangement 6 has two more chambers than the lock arrangement 4 because the two chambers 33 and 34 in the lock arrangement 6 serve for rinsing the already aluminized goods 1. The chambers 32, 35 and 36 correspond to the chambers 31, 30 and 29, respectively, of the lock arrangement 4 and are fundamentally designed identical to the chambers. Thus, for example, the chamber wall 38 corresponds to wall 47, wall 40 corresponds to walls 43 and 45 and wall 41 to the chamber wall 42. The two chamber walls 44 and 46 of the lock arrangement 6 correspond to the chamber wall 39. Since the chamber wall 44 serves not only for sealing but also for rinsing the already aluminized goods, the connecting bore of the chamber wall 44 is connected to an evaporator or condenser 73 by a line 71 with a pump 74 and a valve 72. The inert liquid produced from the electrolyte by means of distillation or condensation in the evaporator is pumped into the longitudinal passages of the chamber wall 44 and into the interstice between the tape-shaped goods 1 and the passages with the assistance of a pump 74. The inert liquid emerging into the chambers 33 and 34 will be enriched with the electrolyte and is re-supplied to the electrolyte reservoir 11 by the corresponding connecting bores and a pipeline or line 75.

Since it is always only a small volume of inert liquid consisting of a few liters, which is diverted out of the large electrolyte reserve 11 by means of condensation or distillation for this rinsing or, respectively, washing operation and this amount is re-introduced into the electrolyte reservoir 11 loaded with a relatively small amount of rinsed-off original electrolyte, the composition and amount of electrolyte in the reservoir 11 remain practically constant. At the same time, the amount of electrolyte discharge from the installation on the goods 1 is reduced to a minimum. Thus the rinsing of the surface of the already treated goods 1 with pure inert liquid represents a highly effective cleansing of the surfaces of adhering electrolyte.

The minimum residues of greatly diluted electrolyte, which may still potentially adhere to the surface of the goods 1, as they depart the chamber 34, are then entirely removed by washing with inert liquid in the chambers 35 and 36, because of the partition 46 which is designed as a liquid lock. The chamber wall 46 is designed in the same manner as the chamber wall 39 and is connected to a reservoir 78 by a connecting bore and pipeline 76 which has a valve 77 and a pump 79. The inert liquid stored in the reservoir 78 is pumped through the corresponding passages of the partition 46 by the pump 79, which partition 46 essentially serves as a liquid lock. The inert liquid is re-conducted or returned to the reservoir 78 by a line 99 which is connected to both the chambers 35 and 36 or, respectively, to the connecting bores of the chamber walls 45 and 46.

As best illustrated in FIG. 2, the tubular cell 5 consists of two rectangular tubes 5*a* and 5*b*, which are flanged at each end and are detachably connected together by the flanged connection 101. The tubes 5*a* and 5*b* receive interchangeable insert pieces 80 and 81 which are matched to the inside dimensions of the rectangular tubes 5*a* and 5*b*. The pieces 80 and 81 are each shaped in such manner that they exhibit longitudinal grooves 82–84 on one surface (FIG. 2*c*). The pieces 80 and 82 are arranged in a pair with the grooves on the one surface facing each other to form channels. As illustrated, the outside channels formed by the pairs or grooves 82 receive outside anodes 85, the center channel formed by grooves 84 received the center anode 86. Between the anode 86 and each outside anodes 85, the grooves 83 form a channel for guiding the strip-like or tape-like goods 1*a* and 1*b*. The anodes are held between the insert pieces 80 and 81 with the assistance of screw 87 and form a unit (see FIG. 2*d*). The longitudinal grooves 82 and 83 are designed in such manner that the insert pieces 80 and 81 are are sealed against the anodes 85, 86. Additional insulating separators 88 are also provided at both sides of the anodes 85 in order to shield the anodes 85 from the rectangular tubes 5*a* and 5*b*. The sides of the insert pieces 80 and 81 facing one another are designed in such manner that they form channels 89 for the electrolyte, which is pumped through the cell 5 from the intake nozzle 10 to the discharge nozzle 9.

As FIG. 2*c* shows, the anodes 85 and 86 are contacted from above with the assistance of contact pins 90 and 91 which can be introduced through insulating separators or members 92. The discharge nozzle 9 is also illustrated in FIGS. 2 and 2*c* as being directly flanged onto the rectangular tube 5*a*.

As can be seen from FIG. 2*d*, the insert pieces 80 and 81 together with the anodes 85 and 86 as well as the insulating separators 88 form an interchangeable structural unit. The centering of said structural unit in the tube 5*a* or 5*b* can be undertaken in such manner that centering springs 95 and 96 (FIG. 2*e*) which are supported in the inside of the rectangular tubes 5*a* and 5*b* are disposed in dead-end bores 93 and 94 of the insert pieces 80 and 81. The springs urge the unit toward the opposite two sides of the tube 5*a*.

FIG. 2*e* also shows the possibility of contacting the tape-shaped goods 1*a* and 1*b* with the assistance of flexible contact pins 97 which are connected to the cathode of the current source. The contact pins 57 are mounted in the wall at the rectangular tubes 5*a* and 5*b* with the assistance of the insulating separators or members 98. Of course, the contacting can also be undertaken by a different structure.

It can be seen from FIGS. 2*c* through 2*e* that the tape-shaped goods 1*a* and 1*b* are only partially aluminized, namely in the center area that is in contact with the electrolyte in the channels 89. When the tape-shaped goods 1*a* and 1*b* are to be aluminized over their entire widths, then the electrolyte must have access to the entire width of the goods 1*a* and 1*b* to be treated. Therefore guidances for the tape-shaped goods 1*a* and 1*b* must then be provided inside the channels 89.

As illustrated in FIGS. 2*a* and 2*b*, the chambers 29 through 36 of the lock arrangements 4 and 6 are relatively simple to manufacture. The chambers practically only consist of rectangular chamber walls 38 through 47 as well as of the rectangular tubes 37 and 37*a*.

As best illustrated in FIG. 2, the unit formed by the pieces 80 and 81 has an end surface or plane 102. The length of the pieces 80 and 81 and the length of the respective outer tube are selected so that the surface 102 does not lie in the plane of the connection 101. By having an offset of the surface 102 from the plane 101, a better seal is obtained.

Although various minor modifications may be suggested by those versed in the art, it should be understood that we wish to embody within the scope of the patent warranted hereon, all such modifications are reasonably and properly come within the scope of our contribution to the art.

We claim:

1. In an installation for electro-deposition of metals particularly for the deposition of aluminum from an aprotic, oxygen-free and water-free aluminum-organic electrolyte onto elongated goods, said installation comprising a tubular cell which is closed to the outside, receives the goods to be treated, has anodes extending therealong, and has means to cathodically contact the goods to be treated; conveying means for moving the goods continuously in an axial direction in the cell along the anodes; and pump means for circulating the electrolyte through the cell in a direction opposite the direction of motion of the goods, said cell having lock means consisting of a plurality of chambers for preventing the outflow of electrolyte from the tubular cell disposed at each end of the tubular cell, the improvements comprising said tubular cell comprising at least two interconnected rectangular metal tubes, each tube having a flange at each end for forming a connection, and interchangeable, nonconductive insert pieces being disposed in said tubular cell, said pieces being matched to the interior dimensions of the rectangular tubes and being shaped to provide at least two longitudinal channels for guiding the goods to be metallized and for positioning the anodes surrounding the goods to be metallized in the flow of electrolyte, and said conveying means and each of the chambers of the lock means being designed along with the two channels to enable simultaneous processing of at least two elongated goods.

2. In an installation according to claim 1, wherein the interchangeable insert pieces are disposed to lie in pairs with the outside surfaces of a pair of pieces being matched to the interior dimensions of the rectangular tube and with the channels for guiding goods to be metallized and for positioning the anodes being on surfaces of the pieces facing each other.

3. In an installation according to claim 2, wherein end piece has grooves for the anodes which are aligned in each pair of pieces so that each anode is supported by the two pieces of said pair.

4. In an installation according to claim 3, wherein each of the insert pieces are rigidly connected to the anodes disposed in the aligned grooves so that a unit is formed, said unit being inserted in the rectangular tube, said pieces forming each unit having a longitudinal dimension so that the end faces of each unit do not fall in the plane of the fastening flange for forming a connection between adjacent tubes.

5. In an installation according to claim 1, which includes contact pins extending through the rectangular metal tube for contacting each of the anodes, said contact pin being insulated from the metal tube by an insulating member.

6. In an installation according to claim 1, wherein the means to cathodically contact the goods to be treated comprises a plurality of resilient contact pins disposed in insulating members and extending through openings in the metal tube with the resilient end of each pin being disposed in a longitudinal groove receiving the goods to be metallized.

7. In an installation according to claim 1, wherein each of the chambers of each lock means have transverse walls, said chambers and transverse walls having a rectangular shape.

8. In an installation according to claim 7, wherein each of the transverse walls of the chambers of the lock means is provided with an opening for each channel of the insert pieces.

9. In an installation according to claim 1, wherein the insert pieces are arranged in pairs with the channels being disposed on surfaces facing each other, and said rectangular tubes including centering springs disposed on a pair of adjacent walls for pressing each pair of pieces against inside wall surfaces on the opposite adjacent walls.

* * * * *